United States Patent [19]

Balbinot

[11] Patent Number: 4,862,603

[45] **Date of Patent: * Sep. 5, 1989**

[54] FOOTWEAR STRUCTURE INCORPORATING A HEATING DEVICE PARTICULARLY FOR SKI BOOTS

[75] Inventor: Renzo Balbinot, Vittorio Veneto, Italy

[73] Assignee: Nordica S.p.A., Montebelluna, Italy

[ * ] Notice: The portion of the term of this patent subsequent to Oct. 6, 2004 has been disclaimed.

[21] Appl. No.: 96,190

[22] Filed: Sep. 14, 1987

Related U.S. Application Data

[63] Continuation-in-part of Ser. No. 861,287, May 9, 1986, Pat. No. 4,697,359.

[30] Foreign Application Priority Data

Jun. 11, 1985 [IT] Italy ..... 22141/85[U]

[51] Int. Cl.[4] ..... A43B 7/02; A43B 5/04

[52] U.S. Cl. ..... 36/2.6; 36/117; 219/211

[58] Field of Search ..... 36/2.6, 117; 219/211, 219/527; 128/383

[56] References Cited

U.S. PATENT DOCUMENTS

| | | | |
|---|---|---|---|
| 3,859,496 | 1/1975 | Giese | 36/2.6 X |
| 4,455,764 | 6/1984 | Rock et al. | 36/2.6 X |
| 4,697,359 | 10/1987 | Balbinot | 36/2.6 |
| 4,780,968 | 11/1988 | Bragagnolo | 36/2.6 |

FOREIGN PATENT DOCUMENTS

| | | | |
|---|---|---|---|
| 146353 | 11/1903 | Fed. Rep. of Germany | 219/211 |
| 3342276 | 6/1985 | Fed. Rep. of Germany | 36/2.6 |
| 2365973 | 4/1978 | France | 36/2.6 |

*Primary Examiner*—James Kee Chi

*Attorney, Agent, or Firm*—Guido Modiano; Albert Josif

[57] ABSTRACT

The footwear structure comprises a shell, including a sole portion and having a quarter connected thereto. The sole portion incorporates an electrical resistance heating circuit, electrically connected to terminals and at least one rechargeable storage battery unit. The structure further comprises a housing, positioned at a rear portion of the quarter, protruding rearwardly, and being adapted for removably receiving the rechargeable storage battery unit, and a circuitry unit for selectively electrically connecting the battery unit to the electrical resistance heating circuit.

7 Claims, 3 Drawing Sheets

FOOTWEAR STRUCTURE INCORPORATING A HEATING DEVICE PARTICULARLY FOR SKI BOOTS

This is a continuation-in-part of the application Ser. No. 06/861,287 filed on May 9, 1986, now U.S. Pat. No. 4,697,359 which is incorporated herein by reference.

BACKGROUND OF THE INVENTION

The present invention relates to a footwear structure incorporating a heating device, particularly for ski boots.

An earlier patent by the same Applicant (U.S. Pat. No. 4.507.877) discloses a heating device, particularly for an inner boot of a ski boot. The device includes a printed circuit electrical resistance heater and rechargeable storage batteries permanently incorporated at a sole region of the inner boot, and a plug, fixed at the upper portion of the inner boot which is adapted for connection to a source of electrical power for the purpose of re-charging the storage batteries.

Also known, for example from a further prior published patent application by the same Applicant (Italian Application No. 20890 B/83, filed on Feb. 22nd, 1983) is a heating device for ski boots which comprises a sock having a printed circuit electrical resistance heater at a sole portion thereof, a container permanently fixed on the sock and including rechargeable storage batteries. A conventional plug for connection with a source of electrical power for re-charging the batteries is also mentioned.

Furthermore, in another earlier published patent application by the same Applicant, (Italian Application No. 21947 B/84, filed on May 29th, 1984) a ski boot is disclosed including an internal heating device which also incorporates a printed circuit electrical resistance heater and rechargeable storage batteries arranged permanently in a seat formation. The device further comprises a socket adapted for connection to a domestic power supply via a lead equipped with suitable plugs, for the purpose of recharging the batteries.

Such known heated ski boot structures however, are not exempt of drawbacks, which reside in the fact that such ski boots have to be taken proximately to a source of electrical energy, in order for the storage batteries incorporated therein to be recharged. Thus, after use, when the storage batteries need to be recharged, the ski boots, which frequently become soiled and wet must be taken indoors and connected to a source of electrical energy.

These prior arrangements, whilst being inconvenient, not least from the standpoint of cleanliness, incur a further serious disadvantage from the standpoint of safety, due to the fact that the ski boot, which may be wet, must be connected to a source of electrical energy and may therefore, inadvertently become a dangerous conductor of such energy.

Another inconvenience of these prior types, is that the ski boots cannot be used whilst the storage batteries are being recharged and that only expensive rechargeable storage batteries are useable.

SUMMARY OF THE INVENTION

Accordingly, it is the task of this invention to provide a footwear structure incorporating a heating device particularly for ski boots wherein storage batteries, either rechargeable or not utilized as an energy source for the heating device, can be either recharged without the compulsory requirement of placing the footwear structure proximate to a source of electrical energy or simply replaced.

Within the above purpose, it is an object of the invention to provide a footwear structure incorporating a heating device, particularly for ski boots, which is completely safe and reliable in use.

It is a further object of the invention, to provide a footwear structure incorporating a heating device, which is not compulsorily subject to inoperative periods whilst storage batteries are being recharged.

A not unimportant object of the invention, is to provide a footwear structure incorporating a heating device, which may be conveniently manufactured by utilization of readily available components and materials.

The above task and these and other objects which will become apparent hereinafter, are achieved by the invention as defined in claim 1.

From the definition of the invention as recited in claim 1, it appears that the gist of the invention should be envisaged in the easy replaceability of the electrical energy source means in the ski boot and that the solution of the problem involved in this easy replaceability is provided on the one hand by the structure of the self-contained receptacle member and on the other hand by the structure and configuration of the seat formation removably, i.e. replaceably, receiving said self-contained receptacle member.

Moreover, the structure of the removably connectable attachment means and of the removably connectable terminal means are also of importance.

In this connection note should be taken of the fact that in the footwear manufacturing field and in particular in the field of ski boot manufacturing, it was believed, prior to this invention, that for the purpose of heating the ski shoe or boot only permanently incorporated rechargeable storage batteries are suitable, owing to the fact that replacement manoeuvering under the usual operative conditions of a ski boot, i.e. low temperatures, snow, humidity etc. would be practically very difficult when it is considered that the user should effect such replacement manoeuvering with gloves.

BRIEF DESCRIPTION OF THE DRAWINGS

Further features and advantages of the invention will become apparent from the following description with reference to the illustrative, non limitative drawings where.

DESCRIPTION OF THE PREFERRED EMBODIMENTS

Figure 1:
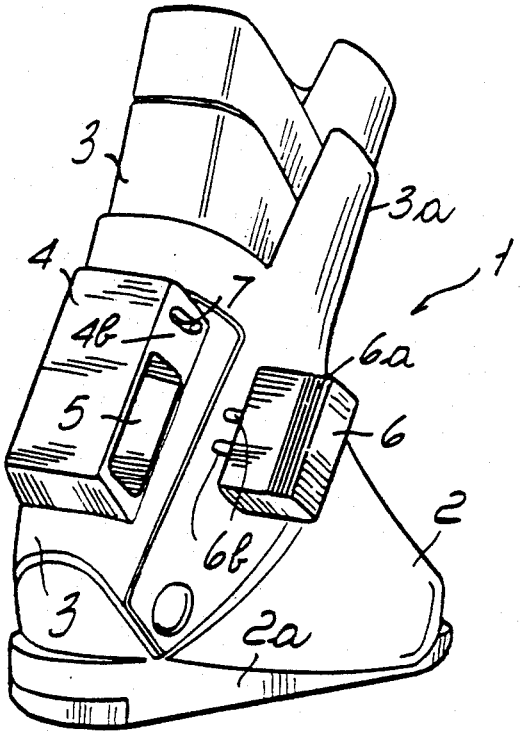
FIG. 1 is a perspective rear view of the footwear structure incorporating a heating device, according to the invention.

With reference to the above cited drawing figures, FIG. 1 shows a footwear structure which in the illustrated case is a ski boot, generally indicated by the reference numeral 1. The ski boot 1 includes a shell 2 having a rear quarter 3 and a front quarter 3*a* connected thereto. The shell 2 includes a sole portion 2*a*, which in a manner known per se, incorporates an electrical resistance heater formed by a printed circuit, electrically connected to the terminals 4*a* (FIG. 3) of a seat or casing formation 4. According to the embodiment shown in FIG. 6, the heater is incorporated in a replaceable insole 8 of the ski boot.

Figure 3:
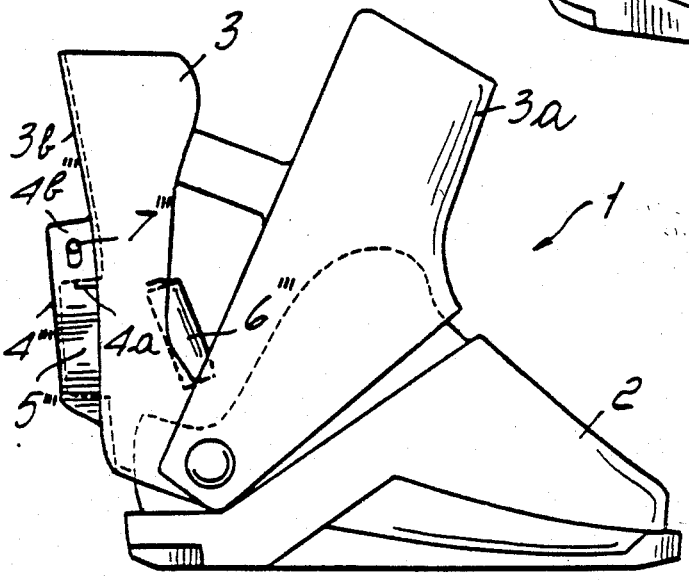
FIG. 3 is a side elevation view of the footwear structure incorporating a heating device according to a further embodiment of the invention.

The casing formation 4 defines a seat 5, formed therein, configured for removably accommodating at least one storage battery receptacle 6, insertable in a manner such that the terminals 6*b* of said at least one storage battery receptacle 6 will communicate with the terminals of the casing formation 4, not shown in the drawing but similar to terminals 4*a* of FIG. 3, to form an electrical contact therebetween, and complete an electrical circuit between the battery contained in the receptacle 6 and the electrical resistance heater incorporated in said sole portion 2*a*.

Advantageously, it is envisaged that a circuit breaker device, actuable by displacement of a small lever or toggle switch 7 be provided in the casing formation 4 to selectively cut-off the flow of electrical energy from the storage battery contained in the receptacle 6 to the electrical resistance heater, when operation of the heating device is not required. When the storage battery contained in the receptacle 6 is of the rechargeable type, circuitry, known per se, may be included preferably in the casing formation 4, which is effective to automatically break the electrical circuit, upon the electrical charge of the storage battery reaching a predetermined minimum level, wherebelow it would be rendered unrechargeable.

In the embodiment illustrated in FIG. 1, the casing formation 4 is positioned at the rear portion of the quarter 3 of the ski boot 1. The casing formation 4, of substantially parallelepipedal shape, which may be either made integral with the rear quarter 3 or attached thereto by fastening means, protrudes unobtrusively rearwardly with respect to rear edge 3*b* (FIG. 3) of the quarter 3, and defines a housing or seat 5 formed therein which is open outwardly at a lateral face 4*b* of the casing formation 4. The toggle switch 7 for actuating the circuit breaker device is located above the housing 5, and proximate thereto, on the lateral face 4*b* of the casing formation 4.

With reference now to the drawing FIG. 2, the embodiment illustrated therein is substantially similar to the embodiment of FIG. 1, described hereinabove, but in this case, the casing formation 4′ is located at the front portion of the ski boot 1 front quarter 3*a*; the housing 5′, being open upwardly, and the toggle switch 7′ being positioned at a side portion of the quarter 3*a*.

Figure 2:
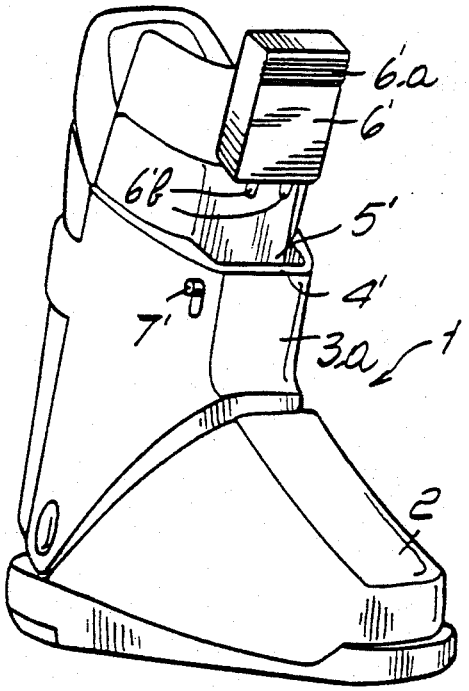
FIG. 2 is a perspective view of a footwear structure incorporating a heating device, according to another embodiment of the invention.

In the illustrated embodiments of both FIGS. 1 and 2, the storage battery contained in the receptacle 6,6′ is of the rechargeable type. The battery receptacle 6,6′ is adapted to be removably inserted into the housing 5,5′ and electrically connectable to the terminals 4*a* (shown only in FIG. 3) provided in the casing formation 4,4′. When fully inserted into the housing 5,5′, a ribbed portion 6*a*,6*a*′ of the battery receptacle 6,6′, protrudes beyond the casing formation 4,4′ such that it may be easily gripped to facilitate removal of the battery receptacle 6,6′ from the housing 5,5′.

The ski boot 1 structure illustrated in drawing FIG. 3, includes a casing formation 4‴ formed at a rear portion of the rear quarter 3. In this embodiment, the seat or housing 5‴ is in the form of a recess open towards the interior of the ski boot 1, thereby defining a recess at the interior rear portion of the quarter 3, whereinto the storage battery receptacle 6‴, the batteries of which in this instance may also be of the ordinary, non-rechargeable type, is insertable. The casing formation 4‴, is substantially completely sealed externally by virtue of the fact that the seat or housing 5‴ is open towards the interior of the ski boot, the toggle switch 7‴, for actuation of the cited circuit breaker device being provided at a lateral face 4*b*‴ of the casing 4‴.

Figure 4:
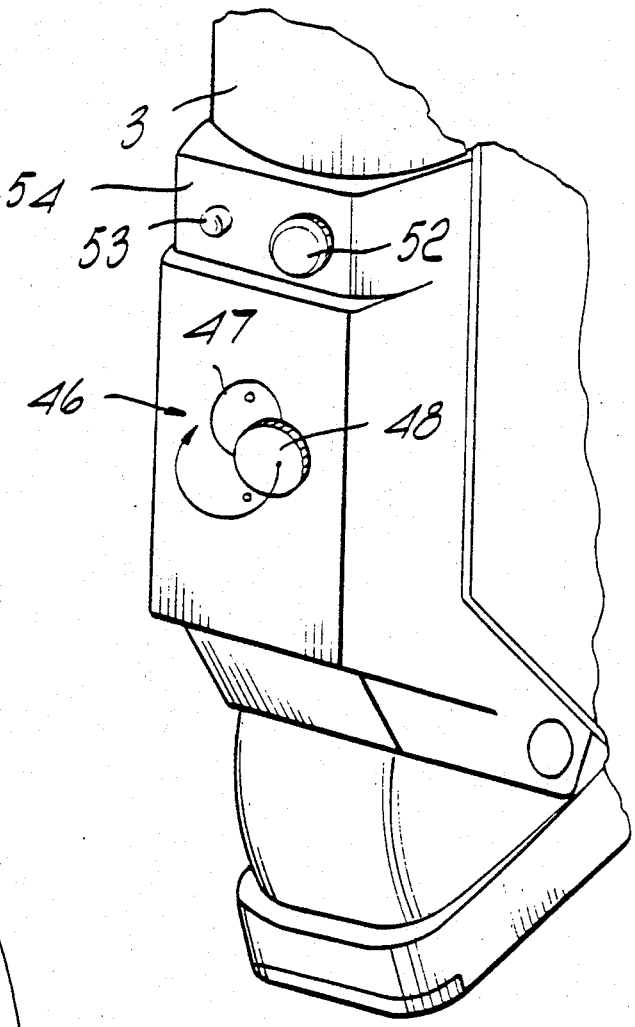
FIG. 4 is a perspective view of the rear portion of the rear quarter of a ski boot incorporating a heating device similar to the one shown in FIG. 3.
Figure 5:
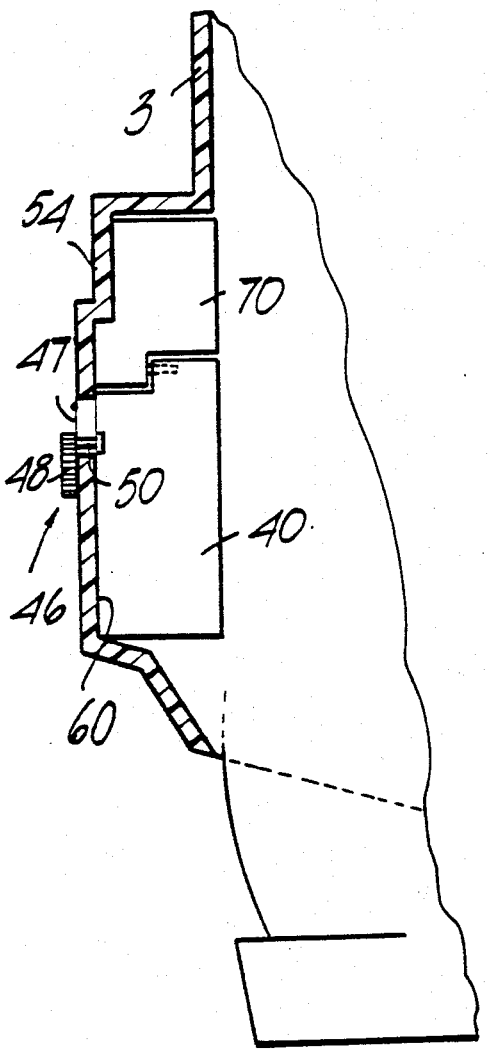
FIG. 5 is an elevational sectional view of a fragment of the embodiment of FIG. 4.
Figure 6:
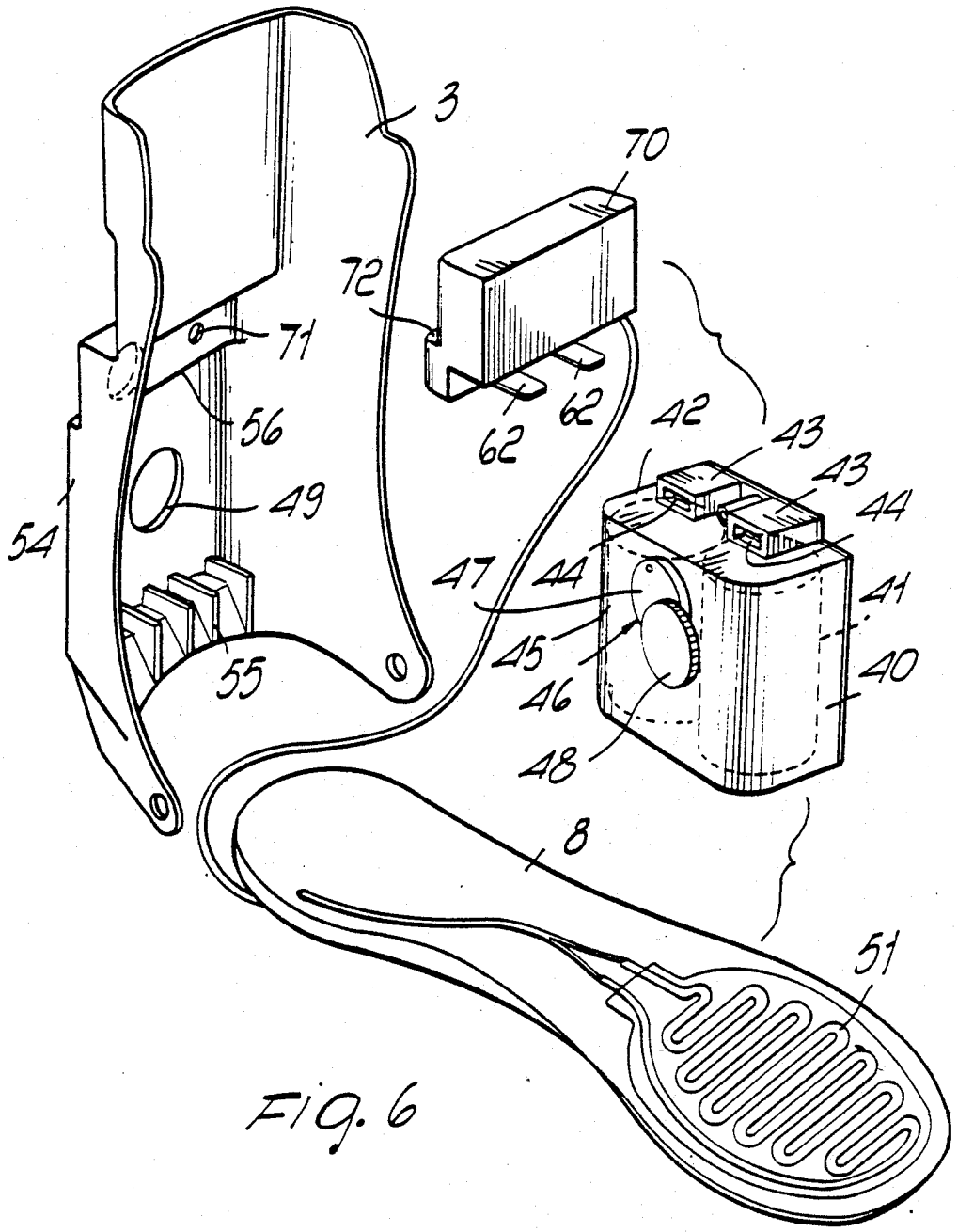
FIG. 6 is an exploded perspective view of the rear quarter viewed in the direction of the inside thereof and of an insole, both incorporating the heating device according to the embodiment of FIG. 4.

In the embodiment shown in FIGS. 4 to 6, the storage battery receptacle member 40 has a substantially parallelepipedal box-like configuration with outer walls of insulating material completely encircling in a sealing manner the inner space of the receptacle in which the storage batteries 41 are arranged. On the top wall 42 a pair of lug formations 43 of insulating material are provided with openings through which terminals in the form of female clips 44 are accessible from the outside, the female clips being electrically connected with the battery poles. On the front wall 45 of the receptacle 40 a locking button 46 is provided which has a fixed disk portion 47 and an eccentrically pivoted disk portion 48 as best visible in FIG. 5. When the receptacle 40 is in its position within the housing 54 or recess 60 the locking button 46 is passed through a hole 49 provided in the wall of the housing 54 so that the fixed disk 47 of the locking button is seated within the hole 49 to maintain the receptacle 40 in position within the recess 60 and the pivotable disk portion 48 of the button may be rotated about the eccentrically arranged pivot 50 to overlap the contiguous wall portion of the housing 54, since the pivotable disk portion 48 projects outside the hole 49. In this way the receptacle 40 is held and locked in position. The electric circuitry through which the flow of current from the storage batteries 41 to the heater 51 (FIG. 6) passes is contained within a second receptacle 70 in which plug terminals 52 are provided to establish electrical connection with the storage batteries when the receptacle 40 is placed in position in which the plug terminals 62 penetrate within the female clips 44 of the receptacle 40 thereby providing also a mechanical fastening connection. The second receptacle 70 has a step-like shape complementary with the lug formations 43 of the receptacle 40 to provide a mating and abutment engagement between the receptacle 40 and the receptacle 70 thereby further increasing the fastening of the receptacle 40 within the seat 60. The circuitry contained in the second receptacle 70 comprises a switch 52 and a spy-light 53. The switch 52 is actuated by rotation about its own axis and is connected with a potentiometer through which the current intensity flowing to the heater 51 may be regulated depending on the angle of rotation of the switch 52. The second receptacle 70 is permanently fixed within the housing 54 by means of screws of which only one hole 71 is shown in FIG. 6. The housing 54 is provided with complementary step-like portions 56 coacting with the step-like formations 72 of the receptacle 70 to maintain it in a stable position even under intense shock actions. On the bottom of the housing 54, ribs 55 (FIG. 6) are provided for supporting thereon the receptacle 40 and increase thereby the shock resistant action of the structure.

The operation of the footwear structure according to the invention is evident from the foregoing description. In order to actuate the heating device incorporated in the structure, it will be sufficient to merely insert in position the storage battery receptacle with charged batteries therein, and translate the toggle switch 7 or 52 to deactivate the circuit breaker device, thereby completing the electrical circuit between the storage battery and the cited heating device 51.

In the case of rechargeable batteries being used with the inventive structure, when such batteries need to be recharged, in the embodiments of FIGS. 1 and 2 it will be sufficient to simply grip the ribbed area 6*a*,6'*a* of the battery receptacle 6,6' protuding beyond the casing 4,4' and exert a pulling force to extract the battery receptacle 6,6' the batteries of which may then be recharged at any convenient location, remote from and independently of the footwear structure itself, by simply electrically connecting the clip terminals 4*a* to an appropriate current supply.

In the case of the embodiment of FIGS. 4–6, the receptacle 40 is inserted in position, upon opening the rear quarter 3 by simply pushing the receptacle 40 into the recess 60 below the permanently fixed receptacle 70 as best visible in FIG. 5. In doing so, the pivotable disk portion 48 of the locking button 46 is placed concentric with the fixed disk portion 47 and upon passing the locking button 46 through the hole 49 the pivotable disk portion 48 is rotated to lock the receptacle 40 in position. At the same time the plug terminals 62 of the circuitry receptacle 70 penetrate into the female clip terminals 44 of the receptacle 40 to provide the necessary electric connection. In order to take out the receptacle 40 it is sufficient to rotate the pivotable disk portion 48 of the locking button into concentric position with the fixed disk portion 47 and to push from the outside towards the inside of the rear quarter the receptacle 40, by acting with a finger onto the locking button 46 so that the receptacle 40 is easily ejected.

Thus, as may be appreciated from the foregoing description, in a footwear structure incorporating a heating device according to the invention, storage batteries can be easily inserted into and extracted from the housing provided on such structure without the need of any special tools or time consuming operations.

Such an arrangement is especially advantageous when rechargeable batteries are used. Removal of the storage battery contained in a sealed receptacle for recharging purposes not only obviates the inconvenience of compulsorily placing a soiled, wet item of footwear indoors and incurring the potential risk of placing it in communication with a supply of electricity, but also permits one storage battery unit to be used whilst another battery unit is being recharged, thereby permitting the footwear to be available for use in a fully operative condition at all times.

This facility is also advantageous, from the point of view that spare battery receptacles with fully charged batteries may be carried by the user of the footwear, so that in the event of the energy stored in one battery unit being consumed, the exhausted battery unit may be quickly removed and replaced with the spare, fully charged battery unit.

A further advantage of the invention, resides in the fact that the inventive structural arrangement permits ordinary throw away batteries to be used instead of the more expensive types of storage batteries comprising nickel-cadmium cells.

The invention disclosed herein is susceptible to many modifications and variations without departing from the inventive concept.

Furthermore, all of the details may be replaced with any other technically equivalent elements.

In practicing the invention any materials, dimensions and contingent shapes may be used according to individual requirements.

I claim:

1. A footwear structure including a composite heating device particularly for ski boots, footwear structure comprising uppers defining portions and sole defining portions, said uppers defining portions comprising a shell and at least a rear quarter connected thereto, the composite heating device comprising electrically powered heating means at least in part arranged in said sole defining portions and electrical energy source means received in a seat formation in said footwear structure and circuit means electrically connecting said electrical energy source means and said electrically powered heating means, wherein said composite heating device further comprises a self contained receptacle member enclosing therein said electrical energy source means and having outwardly exposed electrical terminal means at one surface portion thereof, said seat formation having mating electrical terminal means contained therein and removably connectable with said outwardly exposed electrical terminal means, said mating terminal means being a component part of said circuit means electrically connecting said electrical energy source means and said electrically powered heating means, wherein said sole defining portions comprise an outsole integral with said shell and an insole, said self contained receptacle member further having attachment means for removable attachment with mating attachment means provided in said seat formation, said electrically powered heating means being incorporated within said insole, and wherein said seat formation is in the form of a casing formation integral with said rear quarter and is formed on the rear surface thereof substantially like a hollow parallelepiped body portion having a lateral opening for the insertion therein of said self contained receptacle member.

2. A footwear structure including a composite heating device particularly for ski boots, the footwear structure comprising uppers defining portions and sole defining portions, said uppers defining portions comprising a shell and at least a rear quarter connected thereto, the composite heating device comprising electrically powered heating means at least in part arranged in said sole defining portions and electrical energy source means received in a seat formation in said footwear structure and circuit means electrically connecting said electrical energy source means and said electrically powered heating means, wherein said composite heating device further comprises a self contained receptacle member enclosing therein said electrical energy source means and having outwardly exposed electrical terminal means at one surface portion thereof, said seat formation having mating electrical terminal means contained therein and removably connectable with said outwardly exposed electrical terminal means, said mating terminal means being a component part of said circuit means electrically connecting said electrical energy source means and said electrically powered heating means, wherein said sole defining portions comprise an outsole integral with said shell and an insole, said self contained receptacle member further having attachment means for removable attachment with mating attachment means provided in said seat formation, said electrically powered heating means being incorporated within said insole, and wherein said seat formation is in the form of a recess provided on the inner surface of said rear quarter, the open said of said recess facing inwardly for inserting therein from the inside said self contained receptacle member.

3. A footwear structure according to claim 2, wherein said attachment mean comprise a projection on a first surface of said self contained receptacle member, said first surface engaging said inner surface of said rear quarter, and said mating attachment means comprise a through opening in said rear quarter extending through a rear wall portion of said rear quarter from an inner to an outside surface thereof to engageably receive therein said projection when said self contained receptacle member is arranged within said recess with said first surface thereof engaging said inner surface of said rear quarter, thereby to render said projection accessible from the outside for the ejection of said self contained receptacle member from said recess when said projection is pushed inwardly from the outside with the rear quarter in an opened position.

4. A footwear structure according to claim 3, wherein said projection is in the form of a button pivotally supported on said first surface of said self contained receptacle member about an axis perpendicular thereto and excentric with respect to a center of said button to allow self locking of said self contained receptacle member in position within said recess.

5. A footwear structure according to claim 4, wherein said circuit means include a switch having a switch actuation member projection from said outside surface of said quarter proximate to said button.

6. A footwear structure according to claim 4, wherein said circuit means include a potentiometer and switch circuitry having a potentiometer actuation member projecting from the outside surface of said quarter proximate said button and further include a control light on said outer surface for indicating the operating status of the heating device.

7. A footwear structure according to claim 2, wherein said self contained receptacle member is a first receptacle member and wherein said circuit means are contained in a second receptacle member permanently fixed in said recess formation and providing abutment surface for positioning and locking said first receptacle member.

* * * * *